US009010488B2

(12) United States Patent
Arnal et al.

(10) Patent No.: US 9,010,488 B2
(45) Date of Patent: Apr. 21, 2015

(54) METHOD FOR TETHERING A PERSON TO THE HULL OF A VESSEL

(71) Applicant: Lockheed Martin Corporation, Bethesda, MD (US)

(72) Inventors: David B. Arnal, Mount Laurel, NJ (US); Timothy T. Broderick, Voorhees, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 14/053,191

(22) Filed: Oct. 14, 2013

(65) Prior Publication Data

US 2014/0246269 A1 Sep. 4, 2014

Related U.S. Application Data

(60) Division of application No. 12/402,002, filed on Mar. 11, 2009, now Pat. No. 8,556,031, which is a continuation-in-part of application No. 12/335,958, filed on Dec. 16, 2008, now abandoned.

(51) Int. Cl.
*A62B 35/00* (2006.01)
*B63B 59/06* (2006.01)

(52) U.S. Cl.
CPC ..... *A62B 35/0068* (2013.01); *B63B 59/06* (2013.01)

(58) Field of Classification Search
USPC ..... 182/82
See application file for complete search history.

(56) References Cited

U.S. PATENT DOCUMENTS

| | | | | |
|---|---|---|---|---|
| 3,375,900 | A * | 4/1968 | Conley et al. | 182/150 |
| 3,952,695 | A | 4/1976 | Vollstedt | |
| 4,144,833 | A | 3/1979 | Newman, Sr. | |
| 4,421,205 | A * | 12/1983 | Vranish et al. | 182/82 |
| 5,388,546 | A | 2/1995 | Lombard | |
| 5,746,329 | A | 5/1998 | Rondeau | |
| 6,042,080 | A | 3/2000 | Shepherd et al. | |
| 6,065,787 | A | 5/2000 | Jarosch | |
| 7,367,347 | B2 | 5/2008 | Field | |
| 8,556,031 | B1 * | 10/2013 | Arnal et al. | 182/3 |

* cited by examiner

*Primary Examiner* — Blair M Johnson
(74) *Attorney, Agent, or Firm* — Howard IP Law Group, PC

(57) ABSTRACT

A tether device includes a magnetic base; a pole having a first end attached to the magnetic base; and a connector or clip attached at a second end of the pole, for removably connecting the tethering device to a user. Also, a method for tethering a user to a hull of a vessel including the steps of providing a tether device having a magnetic base, a pole having a first end attached to the magnetic base, and a connector or clip attached at a second end of the pole; connecting the connector or clip to the user; and engaging the magnetic base with the hull of the vessel.

20 Claims, 4 Drawing Sheets

METHOD FOR TETHERING A PERSON TO THE HULL OF A VESSEL

CROSS REFERENCE TO RELATED APPLICATIONS

This application is a division of application Ser. No. 12/402,002 filed Mar. 11, 2009, issuing as U.S. Pat. No. 8,556,031 on Oct. 15, 2013, which is a continuation-in-part of application Ser. No. 12/335,958 filed Dec. 16, 2008, now abandoned, both of which are incorporated by reference herein in their entireties for all purposes.

GOVERNMENTAL INTEREST

This invention was made with Government support under Contract No. N00024-03-C-5115 awarded by the Department of the Navy. The Government has certain rights in this invention.

FIELD OF INVENTION

The present invention relates to a tether device. More particularly, the present invention relates to a tether device and method for tethering a user to a hull of a vessel to enable a user to draw him- or herself toward the inward sloping portions of the vessel's hull to perform painting and other maintenance and repair tasks.

BACKGROUND OF THE INVENTION

When ships and other vessels are floating in water and the hull of the vessel requires painting and/or other maintenance and repairs, a maintenance person must be lowered over the side of the vessel in a support harness to access the exterior side surface of the hull to perform the service. Some portions of the hull slope inward from the point of suspension. To reach these areas, a secondary support must be used to draw the maintenance person close enough to the inward sloping portions of the hull to perform the task.

Permanently welded clips are provided on the hulls of vessels where tethering is required to perform painting and/or other hull maintenance and repairs. The clips are accessed by the maintenance person using a grappling hook. The person then sequentially hooks on and off the clips to move along the hull. This requires a great deal of manual dexterity and increases safety risk during these maneuvers.

The use of welded clips has several disadvantages. The vessel's hull is weakened by the clip welding process due to heating. The discontinuities on the exterior surface of the hull promote corrosion because the paint film is less durable in these areas. Many ships and vessels have in excess of 100 clips welded to the exterior surface of the hull.

Accordingly, a device and/or method is needed that allows the elimination of the welded clips.

SUMMARY

Disclosed herein is a tether device comprising: a magnetic base; a pole having a first end attached to the magnetic base; and a connector or clip attached at a second end of the pole, the connector or clip for removably connecting the tethering device to a user.

Also disclosed herein is a method for tethering a user to a hull of a vessel. The method comprises the steps of: providing a tether device comprising a magnetic base, a pole having a first end attached to the magnetic base, and a connector or clip attached at a second end of the pole; connecting the connector or clip to the user; and engaging the magnetic base with the hull of the vessel.

DETAILED DESCRIPTION OF THE INVENTION

Figure 1:
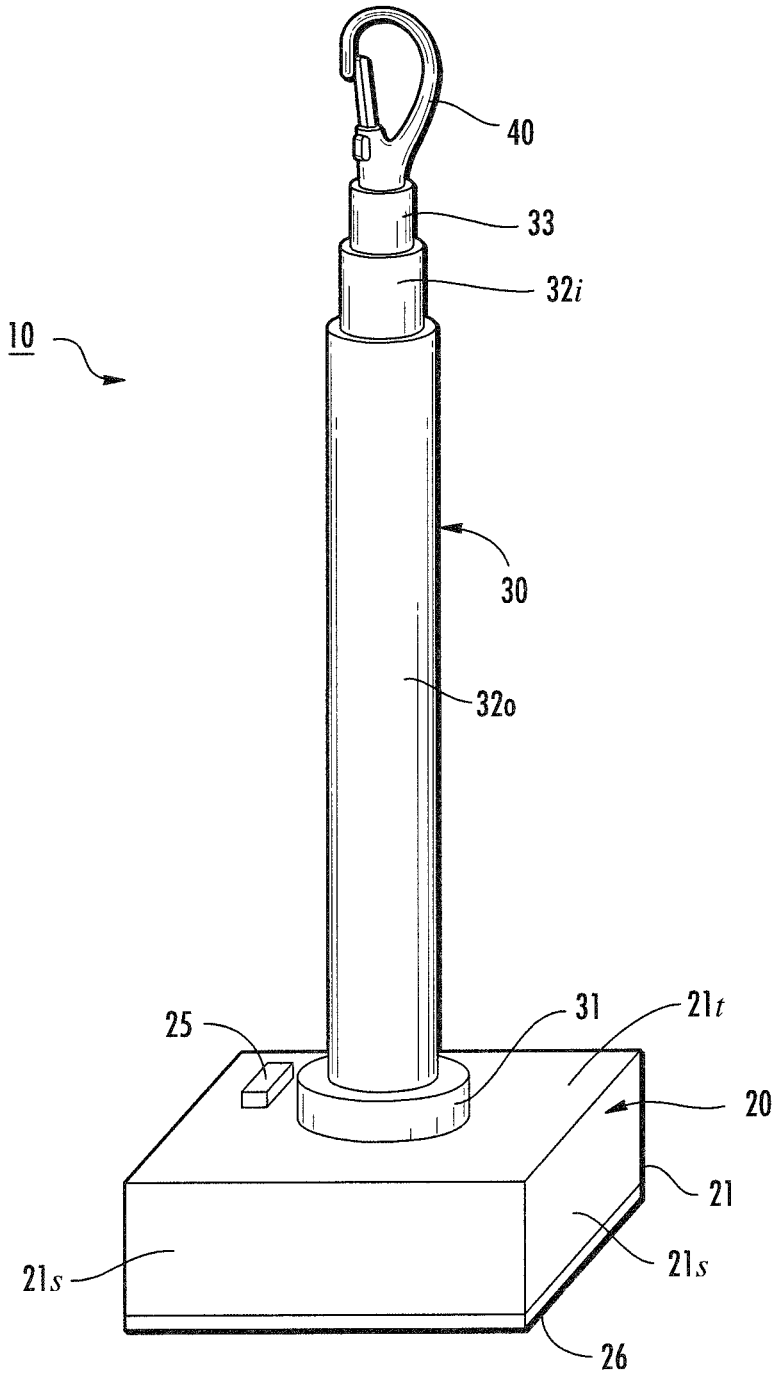
FIG. 1 shows a perspective view of an embodiment of a tether device.
Figure 3:
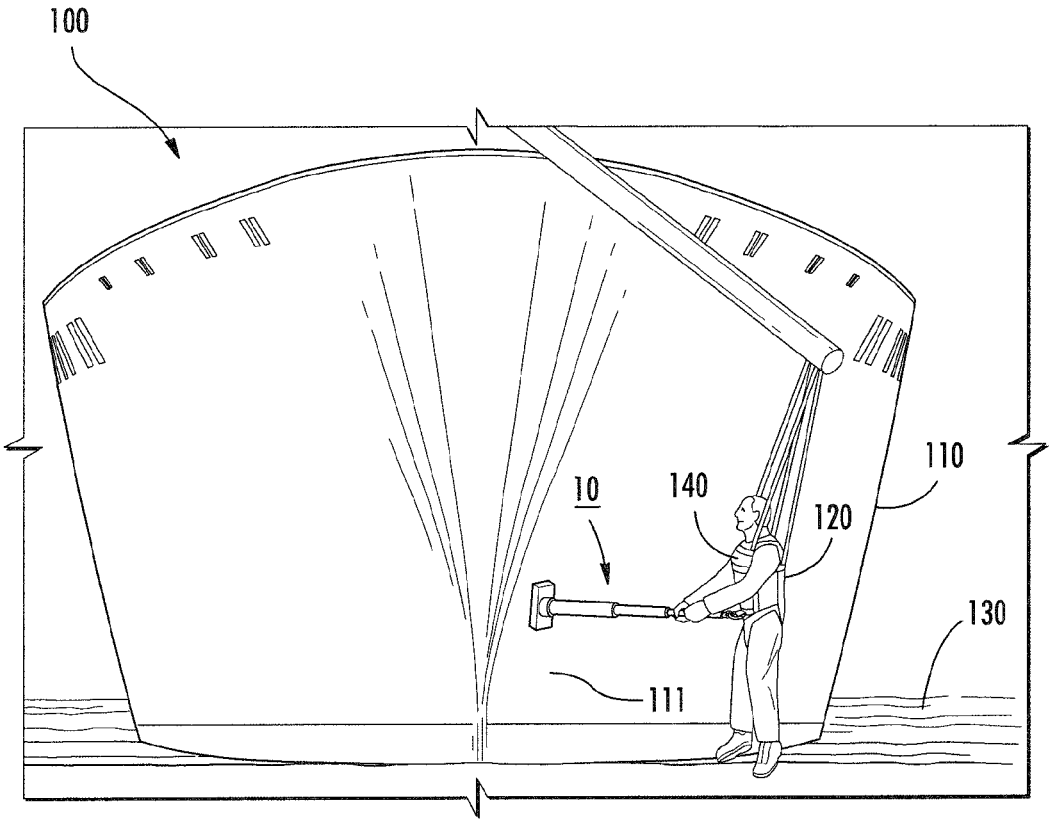
FIG. 3 shows a pictorial representation of the tether device in operation for tethering a user to a hull of a vessel.

FIG. 1 is a perspective view of an embodiment of a tether device 10 for tethering a maintenance person or other user to a hull 110 of a vessel 100. The tether device 10 enables the user to draw him- or herself toward the inward sloping portions of the vessel's hull 110 to perform painting and other maintenance and repair tasks while the vessel 100 is floating on water. In addition, the hull clips which negatively impact the hull of the vessel over the lifecycle of the vessel, may be deleted when the tether device 10 is utilized. The tether device 10 generally comprises a magnetic base 20, a lightweight, elongated tethering pole 30 extending away from the base 20, and a connector or clip 40 disposed at a free end of the pole 30. The magnetic base 20 of the tether device 10 allows it to be magnetically attached to the hull 110 of the floating vessel 100 (FIG. 3). The vessel 100 may include, without limitation, a naval ship, a tanker, a bulk carrier, a container ship as well as a towed or pushed barge.

Figure 2:
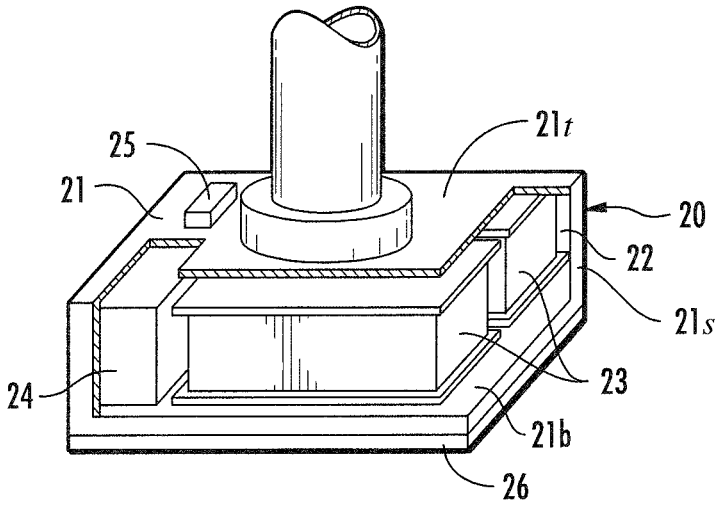
FIG. 2 shows a cut away view of the magnetic base of the tether device.

In one embodiment, as shown in FIG. 2, the magnetic base 20 comprises a housing 21 and one or more electromagnets 23 disposed within the housing 21. The housing 21 includes a top wall 21*t*, at least one side wall 21*s* depending from the top wall, and a bottom wall 21*b*. The top and side walls 21*t*, 21*s* of the housing 21 form an internal compartment 22 for containing the one or more electromagnets 23. The electromagnets 23 are powered by a power source. In one embodiment, the power source may comprise a battery 24 disposed in the internal compartment of the housing 21 with the electromagnets 23. In an alternative embodiment, the power source may comprise an alternating current source. The current source may be obtained from the vessel with suitable electrical power isolation to preclude a shock hazard. A switch arrangement 25 may be provided for allowing a user to selectively connect and disconnect the power source to and from the electromagnets 23 to respectively activate and deactivate of the magnetic base 20. A protective covering 26 may be disposed on the bottom wall 21*b* to protect the exterior surface of the vessel's hull from damage when the tether device 10, is placed thereon. The protective covering 26 may be of any suitable material for preventing marring of a hull's exterior surface. Examples of such materials include, without limitation, felt or other fabrics, plastic, natural or synthetic rubbers, and polymeric foams. In a preferred embodiment, the protective covering 26 comprises the natural or synthetic rubber mentioned earlier because it provides a high degree of friction to prevent sliding.

When activated by the switch arrangement 25, the one or more electromagnets 23 should have sufficient magnetic strength to retain the tether device 10 to the hull 110 of the floating vessel 100, when tethering the user thereto.

Figure 4:
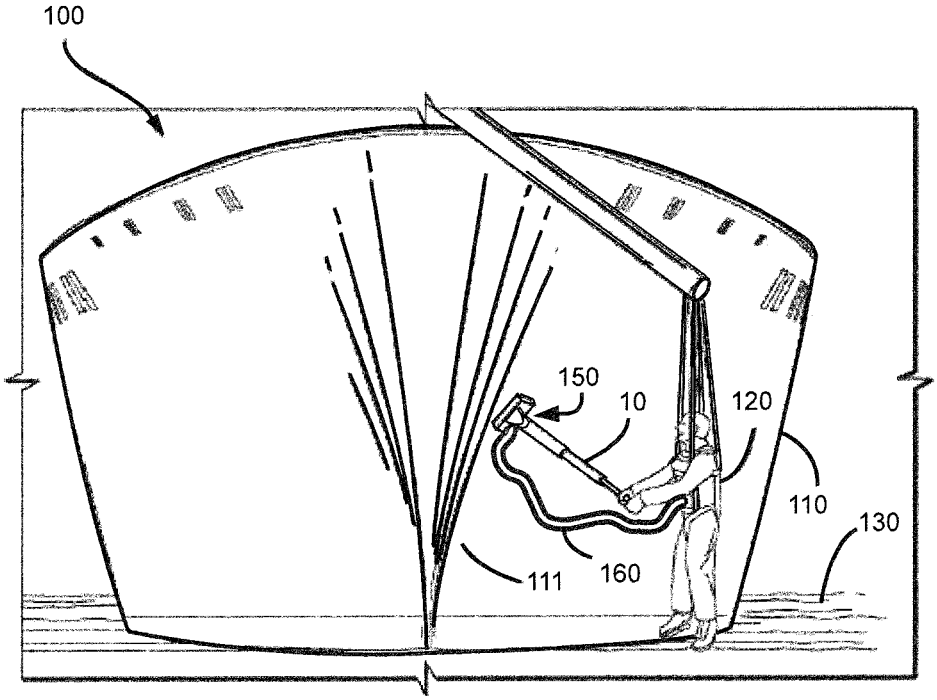
FIG. 4 is a pictorial representation of an embodiment of a tether device according to the application in operation for tethering a person to the hull of a vessel.

Referring again to FIG. 1, the tethering pole 30 is capable of being telescopically extended and collapsed to provide a variably adjustable length to suit stand off distance requirements. In one embodiment, the telescopically adjustable tethering pole 30 comprises a mount 31 fixedly attached (e.g., welded, riveted, screw-fastened, etc.) to the top wall 21*t* of the magnetic base housing 21, two or more telescopically engaged tubes 32*o* and 32*i*, the outer tube 32*o* of which is fixedly connected or pivotally connected (e.g., a ball and socket or like arrangement 150 as shown in FIG. 4) to the mount 31, and a solid rod 33 telescopically disposed within the inner tube 32*i*. The pole 30 may be adapted and dimensioned to provide friction between the outer and inner tubes 32*o* and 32*i* and between the solid rod 33 and inner tube 32*i* to maintain the length of the pole 30, once it has been extended or collapsed to a desired length. Alternatively, the pole 30 may include internal locking rings such as those found on photographic tripods, to maintain the length of the pole 30, once it has been extended or collapsed to a desired length. The outer tube 32*o* may be fixedly connected to the mount 31 using any suitable method. For example, one or more set screws may be used for fixedly connecting the outer tube 32*o* to the mount 31, or the outer tube 32*o* may be threaded into the mount 31. The outer tube 32*o* may also be pivotally connected to the mount 31 using any suitable method. For example, a ball and socket (ball-joint) arrangement (150, shown in FIG. 4) may be used for pivotally connecting the outer tube 32*o* to the mount 31. The connector or clip 40 may be fixedly attached to a free end portion of the rod 33. The connector or clip may comprise a quick release hook or, in another embodiment, a solid loop and a carabiner to allow for attachment and release.

As shown in FIG. 3, the tether device 10 allows a user 120 to draw him- or herself toward the inward sloping portions 111 of the vessel's hull 110 to perform painting and other maintenance and repair tasks while the vessel 100 is floating on water 130. The tether device 10 may also be used to work on non-sloped sections of the vessel's hull 110. In one embodiment, the user 120 attaches the connector or clip 40 of the tether device 10 to the user's suspension harness, clothing, footwear, helmet, belt, and other articles worn (denoted generally by reference numeral 140) by the user 120. After the connector or clip 40 has been attached to the user 120, the user 120 is lowered over the side of the floating vessel 100, adjacent to a sloped section 111 of the hull 110 of the floating vessel 100. The user 120 then activates the electromagnets 23 of the magnetic base 20, by way of the switch arrangement 25, and extends the tethering pole 30, to attach the tether device 10, via the magnetic base 20 to the sloped section 111 of the hull 110 at a selected location thereof, and pulls himself or herself toward the hull 110 of the vessel 100 by collapsing the tethering pole 30 and locking the pole 30 to the desired length. Once the tether pole 30 is collapsed, the user 120 may attach a strap (160, shown in FIG. 4) to the magnetic base 20 and disconnect the tethering pole 30 to allow for greater freedom of movement while performing tasks.

When work at that location of the vessel 100 is completed, the user deactivates the electromagnets 23 of the base 20, via the switch arrangement 25, thereby releasing the magnetic base 20 and thus the tether device 10 from the hull 110 of the vessel 100. If desired, the user 120 can then relocate the magnetic base 20 of the tether device 10 to another location of the hull 110 and repeat the procedure described immediately above. Once work on the vessel 100 has been completed and the user 120 is back on the vessel 100 or dock, the connector or clip 40 may be disconnected from the user's suspension harness, clothing, belt, footwear, helmet, and other worn article 140.

In an alternate embodiment, the electro-magnets may be replaced by one or more permanent magnets. As in the previous embodiment, the one or more permanent magnets should have sufficient magnetic strength to retain the tether device on the hull of the floating vessel, when tethering the user thereto. In this embodiment, magnetic base of the tethering device may be attached and released from the hull of the floating vessel thru mechanical leverage.

In another alternate embodiment, the tethering pole may comprise a single tube instead of the two or more telescopically engaged tubes as previously described. The single tube may be fixedly or pivotally connected to the mount, and a solid rod with a connector or clip fixedly attached to a free end portion thereof, may be telescopically disposed within the tube.

The tethering pole, in still another alternate embodiment, may comprise a fixed length, solid shaft. A first end of the shaft may be fixedly or pivotally connected to the top wall of the magnetic base housing. The connector or clip may be fixedly attached to the free end portion of the rod.

While the foregoing invention has been described with reference to the above, various modifications and changes can be made without departing from the spirit of the invention. Accordingly, all such modifications and changes are considered to be within the scope of the appended claims.

What is claimed is:

1. A method for tethering a user to a hull of a vessel, the method comprising the steps of:

providing a tether device comprising a magnetic base, a pole having a first end attached to the magnetic base, and a connector or clip attached at a second end of the pole;

removably coupling an article for wearing by the user to the connector or clip; and engaging the magnetic base with the hull of the vessel.

2. The method of claim 1, wherein the coupling step is performed by connecting the connector or clip to the article worn by the user.

3. The method of claim 1, wherein the article worn by the user includes at least one of a suspension harness, clothing, footwear, helmet, and a belt.

4. The method of claim 1, further comprising telescopically extending the pole to engage the magnetic base with the hull of the vessel.

5. The method of claim 4, further comprising telescopically collapsing the pole to draw the user toward the hull of the vessel after the extending.

6. The method of claim 4, further comprising:

operating a switch on a surface of the magnetic base to activate a magnet disposed within the magnetic base prior to the engaging of the magnetic base with the hull of the vessel and the telescopically extending of the pole.

7. The method of claim 1, further comprising telescopically collapsing the pole to draw the user toward the hull of the ship.

8. The method of claim 1, further comprising:

operating a switch on a surface of the magnetic base to activate a magnet disposed within the magnetic base prior to the engaging of the magnetic base with the hull of the vessel.

9. The method of claim 1, further comprising the step of disengaging the magnetic base from the hull of the vessel.

10. The method of claim 9, further comprising the step of detaching the connector or clip from the article worn by the user.

11. The method of claim 9, further comprising:

operating a switch disposed on a surface of the magnetic base to deactivate a magnet within the magnetic base prior to the disengaging of the magnetic base from the hull of the vessel.

12. A method of tethering a person to a hull of a vessel, comprising:

attaching a connector or clip of a tether device to an article worn by the person; and engaging a magnetic base of the tether device to a section of the hull of the vessel.

13. The method of claim 12, further comprising:

lowering the person over a side of the vessel adjacent to a sloped section of the hull of the vessel after the attaching of the connector or clip to the article worn by the person.

14. The method of claim 12, further comprising:

activating a magnet within the magnetic base.

15. The method of claim 14, wherein activating the magnet is performed by operating a switch on the tether device.

16. The method of claim 14, further comprising:

extending a pole attached to the magnetic base of the tether device at a first end of the pole and to the connector or clip at a second end of the pole.

17. The method of claim 16, further comprising:

collapsing the pole and locking the pole at a desired length.

18. The method of claim 12, further comprising:

attaching a strap to the magnetic base of the tether device and to the article worn by the person after engaging the magnetic base to the hull of the vessel; and disconnecting the connector or clip from the article worn by the user.

19. The method of claim 12, further comprising:

disengaging the magnetic base of the tether device from the hull of the vessel;

relocating the magnetic base of the tether device to a second section of the hull of the vessel; and reengaging the magnetic base of the tether device to the second section of the hull of the vessel.

20. The method of claim 19, wherein disengaging the magnetic base of the tether device is performed by applying mechanical leverage to the magnetic base.

* * * * *